United States Patent [19]

Wynn

[11] Patent Number: 4,750,573

[45] Date of Patent: Jun. 14, 1988

[54] DRILL BIT HAVING A FLUSH-OUT PORT

[75] Inventor: Kenneth D. Wynn, Evansville, Ind.

[73] Assignee: Baker International Corp., Houston, Tex.

[21] Appl. No.: 805,159

[22] Filed: Dec. 4, 1985

[51] Int. Cl.[4] ..... E21B 10/18

[52] U.S. Cl. ..... 175/337; 175/339; 384/92

[58] Field of Search ..... 175/227, 228, 337, 339, 175/340, 371, 393; 384/92, 93, 473

[56] References Cited

U.S. PATENT DOCUMENTS

| | | | |
|---|---|---|---|
| 1,294,106 | 2/1919 | Humason | 175/227 |
| 1,922,436 | 8/1933 | Herrington | 175/340 |
| 2,200,482 | 5/1940 | Winslow | 175/340 |
| 2,861,780 | 11/1958 | Butler | 175/337 |
| 3,971,600 | 7/1976 | Murdoch et al. | 384/93 |
| 4,372,399 | 2/1983 | Cork | 175/339 |
| 4,375,242 | 3/1983 | Galle | 175/228 |
| 4,386,668 | 6/1983 | Parish | 175/228 |
| 4,646,858 | 3/1987 | Strickland | 175/339 |

*Primary Examiner*—Stephen J. Novosad
*Assistant Examiner*—Terry Lee Melius
*Attorney, Agent, or Firm*—Carl Rowold

[57] ABSTRACT

A roller cutter drill bit detachably secured to a drill string for delivering drilling fluid under pressure to the bit, comprising a plurality of bearing journals at its lower end and passaging extending down in the bit body to each of the journals for flow of the drilling fluid from the drill string to the journals. The bit further comprises a plurality of roller cutters, each having a bore adapted to receive a respective journal, and bearings in the annular cavity between each roller cutter and the respective journal for rotatably mounting the roller cutter on the journal. The drilling fluid when supplied in sufficient quantity flowing through the passaging, past the bearing means and exiting the bit in the bore via the bearing cavity for cooling and cleaning the bearings, but when supplied in insufficient quantity boring cuttings being allowed to enter the bearing cavity and fouling the bearings. In accordance with this invention, the bit is provided with a flush-out port in flow communication with the passaging to the journals for enabling fluid under pressure from a second source other than the drill string to be selectively delivered to the bearings for flushing the bearing cavity when the bit is outside the bore. A plug closes the flush-out port when the bit is not being flushed.

7 Claims, 2 Drawing Sheets

DRILL BIT HAVING A FLUSH-OUT PORT

BACKGROUND OF THE INVENTION

This invention relates to a roller cutter drill bit used to drill bores in the earth and more particularly to a so-called mining roller cutter drill bit of the type adapted to be detachably secured to a drill string for rotating the bit and delivering drilling fluid under pressure to the bit for removing cuttings from the bore and for cooling the bit.

This invention involves an improvement over roller cutter drill bits of the type such as shown for example in U.S. Pat. No. 3,685,601, comprising a bit body having means at its upper end adapted to be detachably secured to a drill string, a plurality of spaced-apart legs at its lower end, each having a bearing journal, and passaging in the bit body extending down to each of the journals for flow of the fluid under pressure to the journals. The bit further includes a plurality of roller cutters, and bearing means between each roller cutter and respective journal for rotatably mounting the roller cutter on the journal. With the bit in the drill bore and with fluid under pressure being supplied to the drill string in sufficient quantity, the fluid flows through the passaging in the body past the bearing means in the bearing cavity and exits the bit via the annular opening between the roller cutter and the journal for cooling and cleaning the bearing means. Upon exiting the bit body, the fluid under pressure then flows up the annulus between the drill string and the well bore carrying cuttings away from the bore bottom. The cuttings consist of dust and relatively small particles of the formation broken from the well bore bottom by the roller cutters.

While the conventional mining drill bit has been generally satisfactory, problems have arisen when the flow of drilling fluid pressure has been insufficient to keep the bearing means clean of cuttings. Typically this happens when the drill bore has been drilled to the desired depth and the drill bit is withdrawn from the bore with the supply of drilling fluid shut off. Entry of cuttings into the bearings may also happen when in drilling, the drill bit unexpectedly drills through a stratem of hard formation into soft formation material. Because the rate of penetration and thus the quantity of cuttings generated in drilling soft formations is greater than in drilling hard formations, the relatively low flow rate of drilling fluid satisfactory for hard formation drilling may be insufficient to keep cuttings out of the bearing cavities during soft formation drilling. In either of these instances of insufficient flow of drilling fluid, the result is that bore cuttings enter the bearing cavity and foul the bearing means thereby rendering the drill bit unusable for further drilling operations unless these cuttings are somehow removed from the bit. Typically, the supplying of drilling fluid in an increased quantity is not adequate to remove the cuttings, particularly once the drill bit is removed from the drill bore and allowed to cool, with the cuttings thus becoming "set" in the bearing cavity.

SUMMARY OF THE INVENTION

Among the several objects of this invention may be noted the provision of a roller cutter drill bit having a feature for enabling cuttings to be flushed out of the bit; the provision of such a drill bit enabling a fluid other than the fluid used for drilling to be utilized to flush the bit clean of cuttings; the provision of such a drill bit which may be readily and rapidly flushed clean of cuttings upon removal from the drill bore and thus before the cuttings become "set" in the bit; and the provision of such a drill bit for which commonly available equipment and materials may be used to flush the drill bit.

In general, the drill bit of this invention comprises a bit body having means at its upper end adpated to be detachably secured to a drill string, a plurality of spaced apart legs at its lower end each having a downwardly and inwardly extending bearing journal of generally cylindrical configuration, and passaging in the bit body extending down in the bit body to each of the journals for flow of the fluid under pressure from the drill string to the journals. The bit further comprises a plurality of roller cutters, one for each journal with each roller cutter being of frusto-conical shape and having a bore of generally circular shape in section adapted to receive the respective journal, and bearing means in the annular cavity between each roller cutter on the journal. When fluid under pressure is supplied to the drill string in sufficient quantity, the fluid flows through the passaging, past the bearing means and exits the bit in the bore via the bearing cavity for cooling and cleaning the bearing means. But, when fluid is supplied in insufficient quantity, bore cuttings, are allowed to enter the bearing cavity and foul the bearing means. A flush-out port is provided in the bit body, in flow communication with the passaging to the journals for enabling fluid under pressure from a second source other than the drill string to be selectively delivered to the bearing means for flushing the bearing cavity and the bearing means when the bit is outside the drill bore. A plug closes the flush-out port when the bit is not being flushed.

BRIEF DESCRIPTION OF THE DRAWINGS

Corresponding reference characters indicate corresponding parts throughout the several view of the drawings.

DESCRIPTION OF THE PREFERRED EMBODIMENTS

Figure 1:
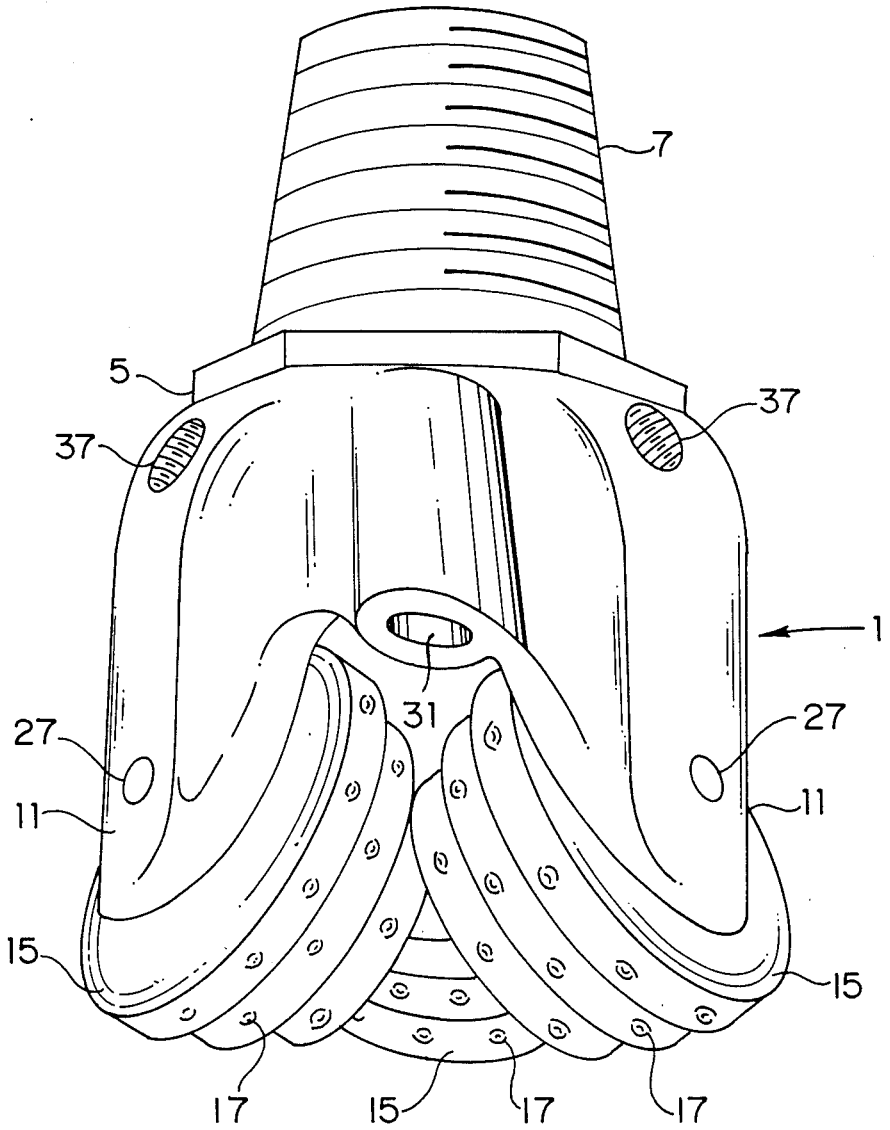
FIG. 1 is a perspective of a drill bit of this invention showing three roller cutters rotatably mounted at the lower end thereof.

Referring to FIG. 1, there is generally indicated at 1, a drill bit of this invention used in conjunction with the drilling fluid circulation system of a drilling machine (not shown) for drilling bores in the earth. In the mining industry, this drilling fluid is typically air under pressure, which is delivered to a tubular drill string (a portion of which is shown in phantom at 3 in FIG. 2) from air compressors (not shown) at the drilling machine. The drill bit comprises a bit body 5 having a threaded pin 7 at its upper end adapted to be threaded in the end of the drill string. The drill string serves to rotate the bit and to deliver the fluid under pressure to the drill bit. The bit body further has a chamber at its upper end (shown in FIG. 2 at 9) for receiving the drilling fluid under pressure from the passage in the drill string, and a plurality of depending legs 11 (e.g., three legs) at its lower end. The legs are spaced apart from the other legs, with each leg having an inwardly and downwardly extending, generally cylindrical bearing journal 13 at its lower end. Roller cutters 15 are rotatably mounted on the bearing journals, each roller cutter comprising a generally conical roller cutter body having a recess in the base thereof receiving the respective bearing journal and a plurality of cutting elements 17 on the conical surface of the body. The cutting elements are adapted to bear on the bottom of the drill bore for drilling the formation.

Figure 2:
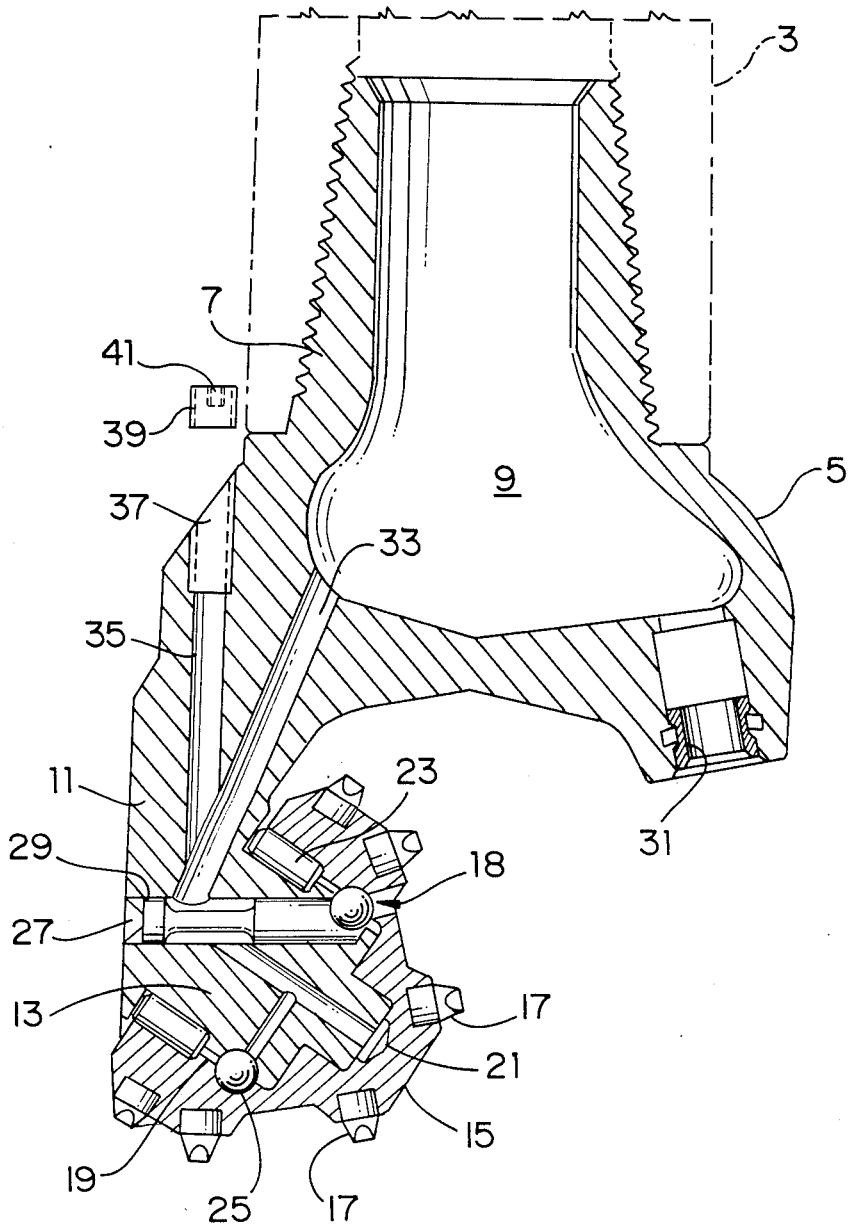
FIG. 2 is a central vertical section through the bit body and one roller cutter thereon, with a plug for a flush-out port shown removed from the bit.

As shown in FIG. 2, bearing means shown generally at 18 in the annular bearing cavity 19 between the roller cutter and the respective journal rotatably mounts the roller cutter on the journal. Typically the bearing means comprises a thrust bearing 21, a set of roller bearings 23 and roller races for carrying loads along the longitudinal axis of the drill bit (e.g., vertical loads when the bit is used to drill down into a formation) and ball bearings 25 and ball races to hold the roller cutter on the journal (i.e., to prevent the roller cutter from sliding down off the journal when the drill bit is lifted). During assembly of the drill bit, the ball bearings 25 are inserted between the ball races via a ball loading port 27 in the leg extending from the side of the bit body, along a portion of the journal and opening into the ball race in the journal. A ball plug 29 secured in the ball loading port, as by welding, after the balls have been inserted, closes the ball port 27 at the side of the bit body and defines the ball race at the opening in the journal to enable the ball bearings to move freely in the race on rotation of the roller cutter.

To deliver drilling fluid under pressure to the drill bore bottom, the drill bit is provided with nozzle passages (e.g., three such passages, one for each roller cutter) extending from the chamber 9 to nozzles 31 at the underside of the bit. The nozzles direct a portion of the drilling fluid under pressure delivered to the bit in high velocity streams toward the drill bore bottom in the space between pairs of adjacent roller cutters. These streams impinge the drill bore bottom, with resultant dislodging of the cuttings on the bore bottom. Thereafter, the drilling fluid flows up the annulus carrying the cuttings away from the bottom, and at the same time cools the outer surface of the roller cutters, which become heated due to friction at the bearing journals.

To further dissipate heat generated at the journals, drilling fluid passaging 33 is provided in the bit body for each journal in flow communication with the chamber 9 and the bearing members. As best illustrated in FIG. 2, the passaging for each journal extends down in the bit body from the chamber to the ball loading port 27, and then to the end and the side of the journal. Drilling fluid under pressure thus flows through the passaging past the ball plug 29, and then exits the bit via the bearing cavity between the roller cutter and the bearing journal. The flow of drilling fluid past the bearing members in the bearing cavity cools the members.

The flow of drilling fluid through the bearing cavity 19 also tends to prevent the entry of cuttings into the cavity which could foul the bearing members. Normally the flow of drilling fluid to the bit and through the passaging 33 is maintained in sufficient quantity to prevent entry of cuttings, and thus keep the bearings free of fouling. However, under certain instances, the flow rate of drilling fluid to the bit may be less than required to prevent entry of cuttings. One such instance occurs when, after completion of drilling, the bit is withdrawn from the drill bore with no drilling fluid being delivered. During withdrawl, the bit is no longer generating new cuttings, nonetheless cuttings already present in the drill bore may enter the bearing cavity and foul the bearing, thereby preventing reuse of the bit in drilling a new bore. Another such instance may occur when the bit unexpectedly drills through a stratum of relatively hard formation and enters a stratum of relatively soft formation. Because the rate of drilling penetration and thus the resultant rate of generating cuttings are less for drilling hard formations than for drilling soft formations, the rate of delivery of drilling fluid to the bit for drilling hard formation is set to be correspondingly lower. When in drilling hard formations, a statrum of soft formation is unexpectedly encountered, the flow of drilling fluid to the bit may be insufficient to prevent entry of cuttings into the bearing cavity.

When entry of cuttings into the bearing cavities is suspected, increased quantities of drilling fluid may be delivered to the bit in an attempt to flush it clean of the cuttings. However, because the drilling fluid utilized is typically air, the increased flow of fluid is often not effective to remove cuttings tightly packed in the bearing cavity. This is particularly true when the bit has been allowed to cool, with the cuttings becoming "set" in the bearing cavity, before flushing is attempted.

In accordance with the teachings of this invention, the bit 1 is provided with a feature enabling cuttings to be flushed from the bearing cavities 19, even cuttings that are tightly packed in the cavities and cuttings that have been allowed to set in the cavities. As best shown in FIG. 2, the bit includes a flush-out port 35 in flow communication at one end thereof with the drilling fluid passaging 33, the ball loading port 27 and thus the bearing cavity 19. The flush-out port at its opposite end opens to an inlet aperture 37 in the side of the bit body for selectively receiving fluid from a second source other than the drill string. This flush-out fluid is preferably water or other solvent liquid that is better able to dislodge and remove cuttings than air. While not shown in the Figs., it is contemplated that the flush-out port may open to an aperture in the chamber 9, and lengths of tubing may also be secured in the chamber to interconnect the flush-out ports for all the journals to a single inlet aperture in the chamber. The flush-out port at the inlet aperture is preferably internally threaded. A plug 39 adapted to be detachably secured as by threaded engagement in the inlet aperture 37 is provided for closing the flush-out port when the bit is not being flushed.

To flush a bit having cuttings in its bearing cavities 19 using the flush-out port of this invention, the bit is withdrawn from the drill bore and the plug is turned by suitable means such as a hand-tool, e.g., an Allen wrench received in a recess 41 on the plug to remove it from the bit. A source of flush-out fluid (not shown) is inserted into the inlet aperture 37 via a hose, tubing or other suitable means. For example, a hose to a source of water under pressure and having a threaded fitting at its end may be threaded into the inlet aperture. Upon delivery of the flush-out fluid to the port, the fluid flows down the flush-out port toward the drilling fluid passaging 33, past the ball plug 29 and to the bearing cavity 19. Cuttings present in the drilling fluid passaging and the ball loading port 27 are carried away by the flush-out fluid exiting the drilling fluid passaging into the chamber 9. With sufficient cuttings removed via the drill fluid passaging to enable flow of the flush-out fluid through the bearing cavity, cuttings in the cavity are removed by the fluid as it exits therefrom. Upon cleaning the bearing cavity, the connection to the source of flush-out fluid is removed, the plug 39 threaded back into the inlet aperture and the above-described process repeated for the remaining bearing cavities. For the contemplated drill bit construction having a single inlet aperture in flow communication with all of the flush-out ports and bearing cavities, all of the cavities 19 may be flushed at one time.

In view of the above, it will be seen that the several objects of the invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

I claim:

1. A roller cutter drill bit adapted to drill bores in the earth and to be detachably secured to a drill string for rotating the bit and delivering drilling fluid under pressure to the bit via a passage in the drill string for removing cuttings from the bore and for cooling the bit; said bit comprising:

(A) a bit body having means at its upper end adapted to be detachably secure to a drill string, a plurality of spaced apart legs at its lower end, each having a downwardly and inwardly extending bearing journal of generally cylindrical configuration, and passaging in the bit body extending down in the bit body to each of the journals for flow of the fluid under pressure from the drill string to the journals;

(B) a plurality of roller cutters, one for each journal, each roller cutter being of frusto-conical shape and having a bore of generally circular shape in section adapted to receive the respective journal;

(C) bearing means in the annular cavity between each roller cutter and the respective journal for rotatably mounting the roller cutter on the journal with the fluid under pressure, when supplied to the drill string in sufficient quantity, flowing through the passaging, past the bearing means and exiting the bit in the bore via the bearing cavity for cooling and cleaning the bearing means, but when supplied in insufficient quantity, bore cuttings being allowed to enter the bearing cavity and fouling the bearing means;

(D) a flush-out port in the bit body, in flow communication with the passaging to a journal for enabling fluid under pressure from a second source other than the drill string to be selectively delivered to the bearing means for flushing the bearing cavity and the bearing means when the bit is outside the drill bore; and (E) a plug removeably secured in the flush-out port for closing the flush-out port when the bit is not being flushed, said plug to fluid flow having means associated therewith adapted to be engaged by a hand-tool for removal of the plug from the flush-out port to enable the drill bit to be flushed with fluid from said second source and for repositioning of the plug in the flush-out port to enable continued use of the drill bit for drilling the drill bore, whereby upon withdrawal of the drill bit from the drill bore but before the bit cools with any cuttings in the bearing cavities thus being allowed to set, the drill bit may be flushed clean of said cuttings thereby enabling further use of the drill bit.

2. A roller cutter drill bit as set forth in claim 1 wherein said fluid under pressure in the drill string is air.

3. A roller cutter drill bit as set forth in claim 1 wherein said fluid under pressure from said second source is water.

4. A roller cutter drill bit as set forth in claim 1 further comprising a plurality of said flush-out ports, one for each journal, and a plurality of plugs, one for each port.

5. A roller cutter drill bit as set forth in claim 4 wherein the flush-out ports are in the outer surface of the bit body.

6. A roller cutter drill bit as set forth in claim 5 wherein each flush-out port in the outer surface of the bit body is internally threaded.

7. A roller cutter drill bit as set forth in claim 6 wherein each plug is externally threaded and adapted to be received in threaded engagement in its respective port.

* * * * *